US006095234A

United States Patent [19]

Huntley

[11] Patent Number: 6,095,234

[45] **Date of Patent: *Aug. 1, 2000**

[54] CONVEYANCE VEHICLES

[75] Inventor: Graeme Huntley, Crawley, United Kingdom

[73] Assignee: BOC Group plc, Windlesham, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/807,841

[22] Filed: Feb. 26, 1997

[30] Foreign Application Priority Data

Feb. 27, 1996 [GB] United Kingdom ..... 9604069

[51] Int. Cl.[7] ..... F28D 15/00

[52] U.S. Cl. ..... 165/47; 277/930

[58] Field of Search ..... 165/47, 104.21; 277/930

[56] References Cited

U.S. PATENT DOCUMENTS 4,494,749 1/1985 Evans ..... 277/930 X 4,660,132 4/1987 Basler et al. ..... 165/47 X

*Primary Examiner*—Leonard Leo

*Attorney, Agent, or Firm*—Salvatore P. Pace

[57] ABSTRACT

A conveyance vehicle for the transportation of a vessel to be evacuated includes a heat sink in the form of one or more heat pipes located adjacent a seal forming part of a gripper assembly. The heat sink inhibits degradation of the seal when subjected to elevated temperatures consequent to engaging the neck of the vessel to be evacuated.

3 Claims, 4 Drawing Sheets

CONVEYANCE VEHICLES

BACKGROUND OF THE INVENTION

The present invention relates to improved conveyance systems for use in the processing of evacuated articles and, more particularly to individual vehicles for use in such systems.

In the production of television picture tubes or other forms of similar tubes, it is generally necessary in a final process stage to evacuate the tube to a residual pressure of less than about $10^{-6}$ mbar whilst allowing for the tube to be heated during at least some of the process stages.

In a typical production line, each tube is mounted on to an individual conveyance vehicle (sometimes referred to as a "cart") with a plurality of such vehicles forming part of a conveyance system in which the vehicles are in slow but continuous motion along straight or circular/oval production lines. Each conveyance system can typically comprise up to two hundred and fifty vehicles with a production line time of, for example, seventy to one hundred minutes (or more depending on the article being processed.)

Each vehicle generally incorporates equipment required to carry out the various finishing process stages for the picture tubes. The known vehicles generally possess a vacuum system in the form, for example, of a diffusion pump or turbomolecular pump backed by a rotary pump.

The known vehicles conventionally possess a gripper assembly including a seal for receiving the "neck" of the television tube and sealingly connecting the interior of the tube to the vacuum system for maintaining a vacuum therein.

However, in order to inhibit degradation of the seal during subsequent heating of the television tube it is known to use water cooling to effect cooling of the gripper assembly and in particular the seal.

The use of water cooling with moving vehicles is complicated and gives rise to maintenance problems and low reliability.

It is an aim of the present invention to provide a conveyance vehicle for the transportation of a vessel to be evacuated in which the use of a water cooling system is avoided.

SUMMARY OF THE INVENTION

According to the present invention a conveyance vehicle for the transportation of a vessel to be evacuated comprises:

a) a vacuum pumping system;

b) a gripper assembly for receiving an initially open neck of the vessel;

c) the gripper assembly including a seal for sealingly connecting the interior of the vessel to the vacuum pumping system via the neck; and d) a heat sink located adjacent the seal for inhibiting degradation of the seal when subjected to elevated temperatures.

Preferably, the heat sink is in the form of at least one heat pipe.

The heat pipe can be thermally connected at one end to the gripper assembly and at its opposite end to cooling fins.

BRIEF DESCRIPTION OF THE DRAWINGS

An embodiment of the invention will now be described, by way of example, reference being made to the Figures of the accompanying diagrammatic drawings in which.

DETAILED DESCRIPTION

Figure 1:
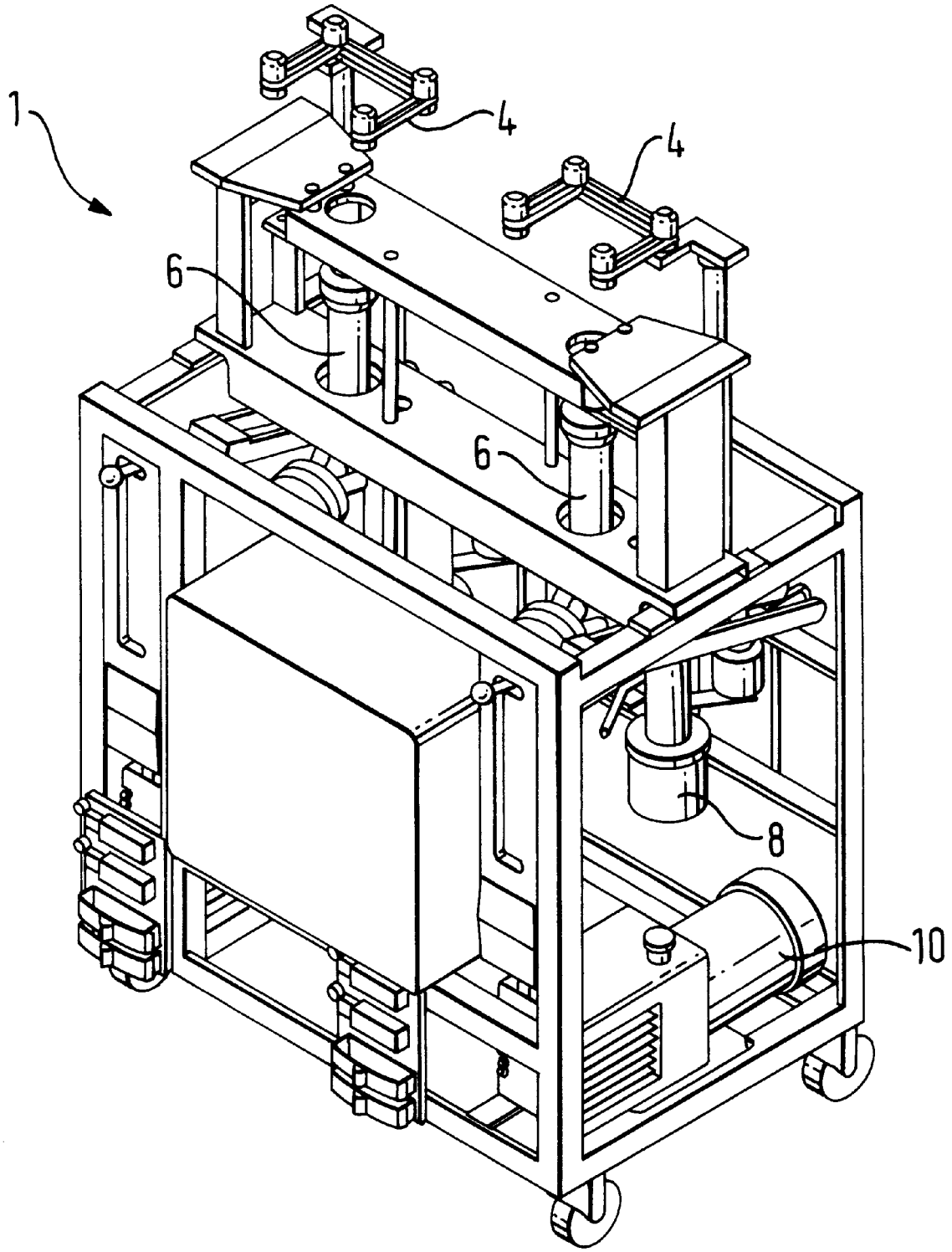
FIG. 1 is a perspective view of a conveyance vehicle.
Figure 2:
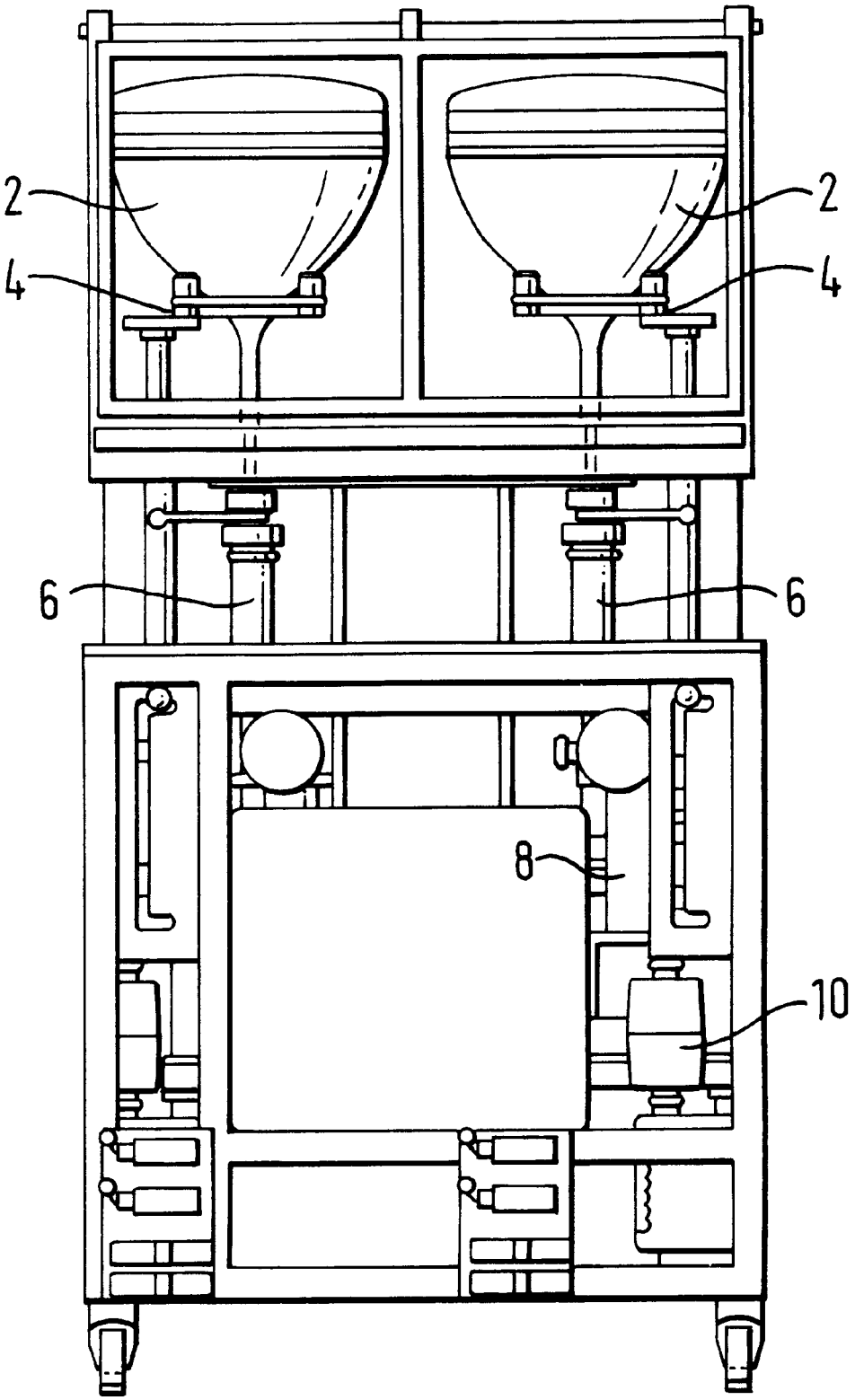
FIG. 2 is an end elevation of the conveyance vehicle of FIG. 1 shown carrying two television tubes.

Referring first to FIGS. 1 and 2, there is shown a conveyance vehicle or 'cart' 1 for the transportation of television tubes 2. Each television tube 2 is mounted on a tube support 4 and the initially open neck is received within the open (upper as shown) end of a gripper assembly 6. Each gripper assembly 6 communicates with a vacuum pumping system including a diffusion pump 8 and an associated backing pump 10 in the form of an oil-sealed rotary pump.

Figure 3:
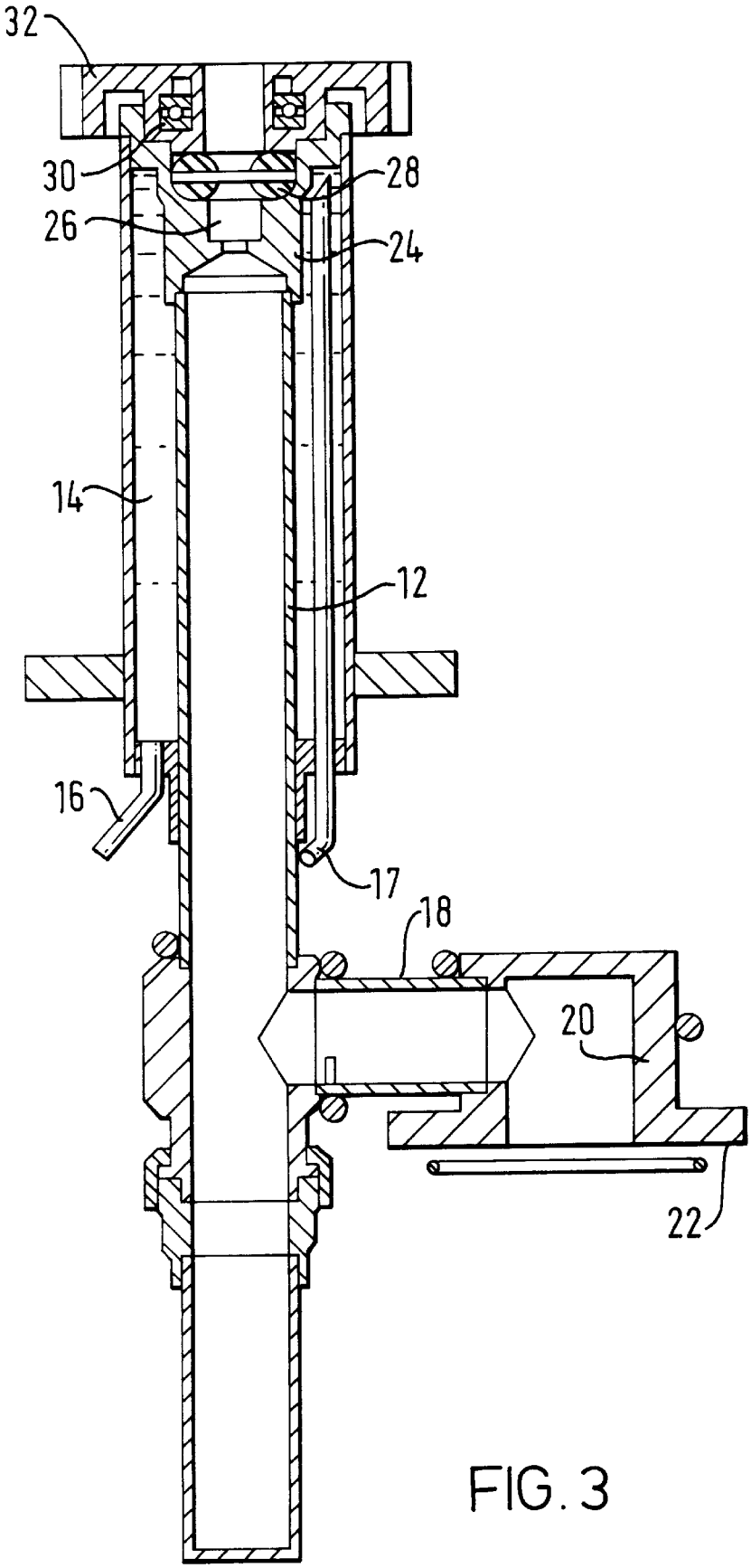
FIG. 3 is a cross-section through a known gripper assembly.

Turning now to FIG. 3 which illustrates a conventional gripper assembly, the main components of which are a main tubular part 12 surrounded by a water jacket 14 including a cooling water inlet 16 and a cooling water outlet 17; and a tubular extension 18 connected to a support head 20.

The support head 20 includes a flange 22 to which the diffusion pump 8 is attached.

The main tubular part 12 is terminated at its upper (as shown) end by an end-piece 24 of good thermal conducting material which includes a through passage 26 and a counterbore for receiving an o-ring seal 28. Mounted on the end-piece 24 is a ball bearing assembly 30 and a clamp nut 32.

The end-piece 24 and clamp nut 32 are designed to receive the initially open neck of a television tube 2 and the seal 28, sealingly engages the neck to ensure vacuum tight communication between the interior of the television tube 2 and the vacuum pumping system including the diffusion pump 8.

When in use, water is circulated through the water jacket 14 to ensure the seal 28 does not become degraded through contact with the neck of the television tube 2 when said tube 2 is being heated.

Figure 4:
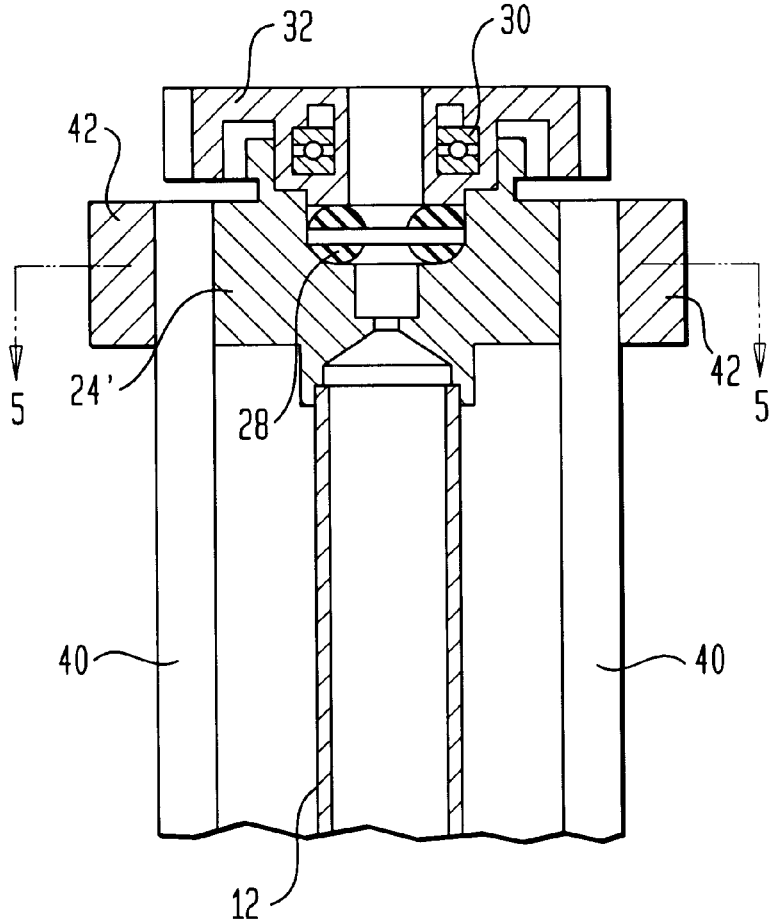
FIG. 4 is a detail in cross-section of a gripper assembly and a heat sink according to the present invention.
Figure 5:
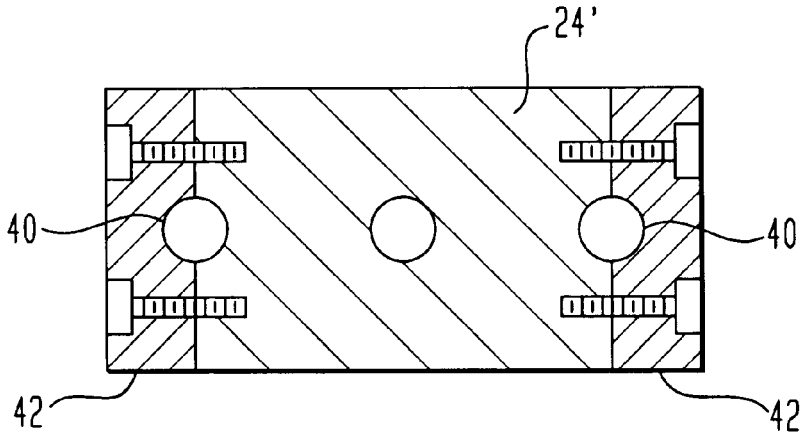
FIG. 5 is a view on the line A—A of FIG. 4.

According to the present invention the known gripper assembly illustrated in FIG. 3 is modified as illustrated in FIGS. 4 and 5. The cooling water jacket 14 is discarded and replaced by a heat sink in the form of two heat pipes 40. As shown, each heat pipe 40 at its upper (as shown) end is clamped and thermally connected to the end-piece 24 by means of a side member 42. Each heat pipe 40 is a pressure vessel which exhibits a thermal conductivity some 1000 times better than that of copper. The bottom (not shown) end of each heat pipe 40 is thermally attached to cooling fins which can be aligned with the fins of an air cooled diffusion pump.

The use of the heat pipes 40 to conduct heat away from the gripper assembly 6 and in particular the o-ring seal 28 obviates the need for a relatively complicated water cooled system.

What is claimed is:

1. A conveyance vehicle for the transportation of a vessel to be evacuated, the vehicle comprising:

a vacuum pumping system;

a gripper assembly for receiving an initially open neck of the vessel;

the gripper assembly including a main tubular part terminating at an upper end by an end-piece of good thermal conducting material, the end piece having a seal for sealingly connecting the interior of the vessel to the vacuum pumping system via the neck; and at least one heat pipe connected to the end-piece adjacent the seal to conduct heat from the seal, thereby to inhibit degradation of the seal when subjected to elevated temperatures.

2. The conveyance vehicle of claim 1, wherein:

said end-piece also includes a through passage, a counterbore, and a clamp nut; and said seal is an o-ring seal located within said counterbore.

3. The conveyance vehicle of claim 1, wherein two of said heat pipes are connected to said head piece.

* * * * *